US008496396B1

(12) United States Patent
Allen

(10) Patent No.: US 8,496,396 B1
(45) Date of Patent: Jul. 30, 2013

(54) WIRE MESH FOR PERVIOUS CONCRETE

(75) Inventor: Jeffrey J. Allen, Minooka, IL (US)

(73) Assignee: JJA Engineering, LLC, Minooka, IL (US)

( * ) Notice: Subject to any disclaimer, the term of this patent is extended or adjusted under 35 U.S.C. 154(b) by 0 days.

(21) Appl. No.: 13/547,580

(22) Filed: Jul. 12, 2012

(51) Int. Cl.
*E01C 5/08* (2006.01)

(52) U.S. Cl.
USPC ..... 404/36; 404/45; 52/405.3; 52/576

(58) Field of Classification Search
USPC ..... 52/405.3, 576, 577, 600, 649.1, 676; 404/2.3, 36, 45; 405/20, 302.4, 302.6
See application file for complete search history.

(56) References Cited

U.S. PATENT DOCUMENTS

| | | | | | |
|---|---|---|---|---|---|
| 422,901 | A * | 3/1890 | Arnett | 405/114 |
| 3,665,669 | A * | 5/1972 | Huber | 52/592.3 |
| 4,139,319 | A * | 2/1979 | Anderson | 405/16 |
| 4,388,015 | A | 6/1983 | Honegger | |
| 4,398,842 | A | 8/1983 | Hodson | |
| 4,683,156 | A * | 7/1987 | Waters | 428/52 |
| 5,250,340 | A * | 10/1993 | Bohnhoff | 428/99 |
| 5,400,561 | A | 3/1995 | Metten | |
| 5,449,246 | A | 9/1995 | Housley | |
| 5,702,208 | A * | 12/1997 | Hilfiker et al. | 405/302.4 |
| 6,276,870 | B1 * | 8/2001 | Smith | 405/17 |
| 6,416,253 | B1 * | 7/2002 | Wimp et al. | 405/172 |
| 6,585,449 | B2 | 7/2003 | Chen | |
| 6,739,797 | B1 * | 5/2004 | Schneider | 404/35 |
| 6,955,015 | B2 * | 10/2005 | Manthei | 52/223.7 |
| 6,955,500 | B1 * | 10/2005 | Smith et al. | 405/20 |
| 6,962,463 | B2 * | 11/2005 | Chen | 404/75 |
| 6,962,464 | B1 | 11/2005 | Chen | |
| 7,037,037 | B1 * | 5/2006 | Smith et al. | 405/20 |
| 7,546,712 | B2 | 6/2009 | Shaw | |
| 7,823,858 | B2 | 11/2010 | Matsufuji et al. | |

* cited by examiner

*Primary Examiner* — Gary Hartmann
(74) *Attorney, Agent, or Firm* — McDermott Will & Emery LLP

(57) ABSTRACT

A mesh assembly for the formation of pervious pavement is disclosed. The mesh is defined by a plurality of elongated structural members. The mesh has a first side and a second side. A plurality of conduits are coupled to and extend through the mesh. Each conduit has a first end defining a first opening, a second end defining a second opening, and a passageway extending between the first opening and the second opening. The plurality of conduits each have at least one of the elongated structural members extending through a sidewall of the conduit such that the first opening is positioned on the first side of the mesh and the second opening is positioned on the second side of the mesh.

22 Claims, 2 Drawing Sheets

WIRE MESH FOR PERVIOUS CONCRETE

TECHNICAL FIELD

The present invention relates generally to a wire mesh used for reinforcing poured concrete, and more specifically to a wire mesh including drainage conduits that extend through the concrete after the concrete has been poured to render the concrete pervious.

BACKGROUND

Standard techniques for making concrete pavement involve pouring liquid concrete over a wire mesh that is suspended above a subgrade surface. The subgrade surface may include gravel, sand, and other materials, depending on the application. The wire mesh reinforces and strengthens the concrete. To prevent water from collecting on the surface of the cured concrete, the concrete must be graded prior to curing so that water flows in a desired direction, often toward a dedicated collection area such as a sewer grate or drain. The process of properly grading concrete requires a skilled hand and can be quite time consuming. Furthermore, the use of dedicated collection areas, particularly when dealing with large areas of pavement, can lead to overflows and backups, and requires a significant amount of additional infrastructure to properly manage the large amounts of collected water.

SUMMARY

The present invention generally provides a pervious pavement. According to one embodiment, a mesh assembly is provided for the formation of the pervious pavement. The mesh assembly comprises a plurality of wires coupled together to form a mesh having a first side and a second side, the plurality of wires defining wire intersections; and, a plurality of conduits coupled to and extending through the mesh, each conduit defining a first opening on the first side of the mesh and a second opening on the second side of the mesh, and surrounding one of the wire intersections such that the wire intersection is located within the conduit.

According to another embodiment, a mesh assembly for the formation of pervious pavement is disclosed. The mesh assembly comprises: a plurality of elongated structural members defining a mesh, the mesh having a first side and a second side; and, a plurality of conduits, each conduit having a first end defining a first opening, a second end defining a second opening, and a passageway extending between the first opening and the second opening, the plurality of conduits coupled to and extending through the mesh, each conduit having at least one of the elongated structural members extending through a sidewall of the conduit, wherein the first opening is positioned on the first side of the mesh and the second opening is positioned on the second side of the mesh.

According to another embodiment, a mesh assembly is provided for the formation of pervious pavement. The mesh assembly comprises: a structural reinforcing mesh having a first side and a second side; and a plurality of conduits formed separately from and non-removably attached to the reinforcing mesh, each conduit having a first portion defining a first opening and positioned on the first side of the mesh, a second portion defining a second opening and positioned on the second side of the mesh, and a passageway extending between the first opening and the second opening.

According to another embodiment, each conduit includes a first end defining the first opening and a second end defining the second opening, wherein the second openings are adapted to be engageable with a subgrade surface and wherein the plurality of conduits include sufficient rigidity to support the mesh a distance above the subgrade surface.

According to another embodiment, a plurality of caps are provided, each cap received by the first opening of a respective one of the plurality of conduits. Each cap includes a ferromagnetic insert for removing the cap from the first opening of the respective one of the plurality of conduits using a magnetic force.

Other features and advantages of the invention will be apparent from the following specification taken in conjunction with the following drawings.

BRIEF DESCRIPTION OF THE DRAWINGS

To understand the present invention, it will now be described by way of example only, not by way of limitation, with reference to the accompanying drawings.

DETAILED DESCRIPTION

Figure 1:
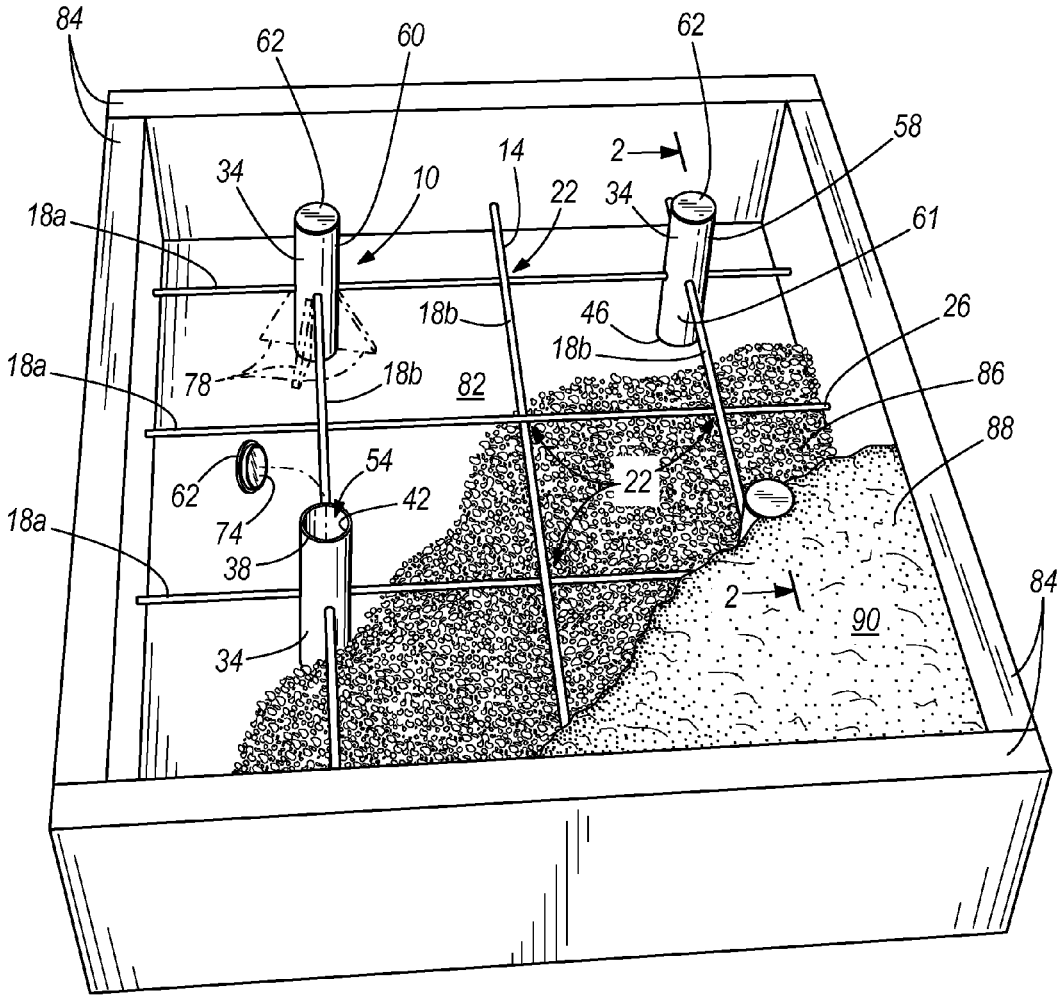
FIG. 1 is a perspective view of previous pavement sample installation including a wire mesh with tubular inserts.

While the subject matter of this disclosure can be embodied in many different forms, there is shown in the drawings and will herein be described in detail preferred embodiments with the understanding that the present disclosure is to be considered as an exemplification of certain principles and is not intended to limit the broad aspects of the disclosed subject matter to the embodiment(s) illustrated.

Figure 2:
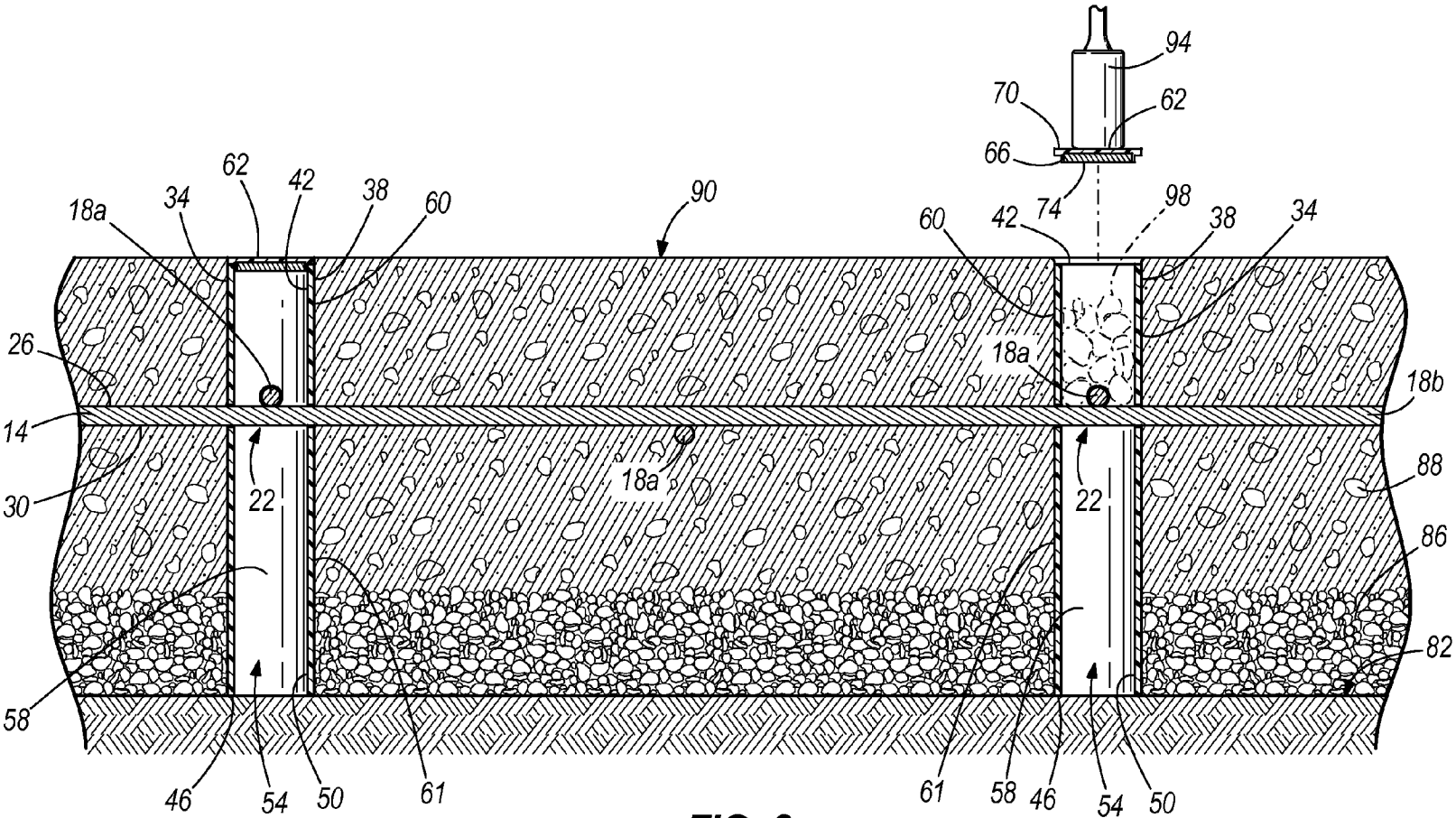
FIG. 2 is a section view taken along line 2-2 of FIG. 1 and showing the installation including the wire mesh with tubular inserts after completion of the pervious pavement.

Referring now to the figures, and specifically to FIGS. 1 and 2, a mesh assembly 10 is provided for the formation of pervious pavement. The mesh assembly 10 includes a structural reinforcing mesh 14 formed by first and second sets of elongated structural members 18*a*, 18*b*. The first set of elongated structural members 18*a* extend generally in a first direction, and the second set of elongated structural members 18*b* extend generally in a second direction that is angled with respect to the first direction. The mesh 14 includes a plurality of intersections 22 and has a first side 26 and a second side 30 opposite the first side 26. A plurality of conduits 34 are formed separately from and coupled to the mesh 14.

In the illustrated embodiment, the members 18*a*, 18*b* are formed from structurally reinforcing steel wire, such as, for example, 10 gauge steel wire, and are woven or interlaced with one another. In other embodiments, the mesh 14 can be formed by rebar, one or more stampings, cables, wires of different sizes, combinations of rebar, stampings, wires, and/or cable, and the like, which may be formed of metals, polymers, composites, and the like. In some embodiments, the woven or interlaced nature of the mesh 14 couples the members 18*a*, 18*b* to each other. In other embodiments, the members 18*a*, 18*b* may be coupled together by the conduits 34. In still other embodiments, the members 18*a*, 18*b* may be joined by welding, brazing, adhesives, fasteners, tie-wire, and the like. In the illustrated embodiment the first set of elongated structural members 18*a* and the second set of elongated structural members 18*b* are substantially perpendicular to one another. In other embodiments the members 18*a*, 18*b* can be oriented at other angles with respect to one another, and can include additional sets of members oriented at different angles to the first and second set 18*a*, 18*b*.

As best shown in FIG. 2, each conduit 34 includes a first end 38 defining a first opening 42, a second end 46 opposite the first end 38 and defining a second opening 50, and a passageway 54 extending between the first opening 42 and the second opening 50. In one embodiment, each conduit 34 is substantially tubular and includes a sidewall 58. In an alternate embodiment, not shown, the conduits 34 are slightly conical, with the larger opening being placed adjacent the subgrade surface 82 during installation. Conical conduits 34 allow for stacking of the mesh assemblies 10 for storage purposes. The conduits 34 are coupled to the mesh 14 such that the first opening 42 is positioned on the first side 26 of the mesh 14 and the second opening 50 is positioned on the second side 30 of the mesh 14. In the illustrated embodiment the conduits 34 extend substantially perpendicularly through the mesh 14, but in other embodiments one or more of the conduits 34 may extend through the mesh 10 at other angles.

In the illustrated embodiment, the conduits 34 are non-removably attached to the mesh 14 by having one of the first set of elongated structural members 18*a* and one of the second set of elongated structural members 18*b* extending through the sidewall 58. More specifically, the illustrated conduits 34 are positioned on the mesh 14 such that each conduit 34 surrounds one of the intersections 22. In this regard, individual intersections 22 are located within the passageway 54 of a respective conduit 34. In other embodiments, one or more of the conduits 34 may be positioned with the mesh 14 such that only one elongated structural member 18*a*, 18*b* extends through the sidewall 58 of one or more of the conduits 34. To increase the lifespan of the structural members 18 of the mesh 14 located within the passageway 54 of the respective conduits 34, the structural members 18 within the conduits 34 may have an epoxy or other coating applied on their surface thereto, for example, to assist in rust prevention of the mesh 14 material. In one embodiment the coating is applied to the structural members 18 by a spray process after the structural members 18 are positioned within the conduits 34. Alternately, the coating may be applied prior to installation of the structural members 18 within the conduits 34. In still other embodiments, one or more of the conduits 34 may be attached to the mesh in a different way that does not necessarily involve having one of the elongated structural members 18*a*, 18*b* extending through the sidewall 58, for example, by welding, brazing, epoxy, or the like.

In one embodiment, the conduits 34 are formed of plastic and are overmolded onto the mesh 14. In this regard, the mesh 14 may be formed of a first material and the conduits 34 may be formed of a second material different from the first material. In other embodiments, openings may be pre-formed in the sidewalls 58 of the conduits 34 and the individual structural members 18*a*, 18*b* may be threaded through openings to form the mesh 14. In each case, the conduits 34 are located such that a first or upper portion 60 of the conduit 34, which includes the first end 38 and first opening 42, is located on the first side 26 of the mesh 14, and a second or lower portion 61 of the conduit 34, which includes the second end 46 and the second opening 50, is located on the second side 30 of the mesh 14.

In some embodiments, the mesh assembly 10 also includes a plurality of caps 62. Each cap 62 is configured to be received by the first opening 42 of a respective one of the conduits 34. In the illustrated embodiment, each cap 62 includes a sleeve portion 66 that fits within the first opening 42 and a flange portion 70 that engages the first end 38 of the conduit. In some embodiments, the caps 62 are each provided with a ferromagnetic insert 74. In other embodiments, the caps 62 may themselves be formed of a ferromagnetic material. As used herein, "ferromagnetic material" refers to a material that is itself a magnet or that is attracted to a magnet. The caps 62 are provided to substantially prevent material, such as paving material, from entering the conduits 34 through the first opening 42 when the pervious pavement is being prepared, as discussed further below. As shown in phantom in FIG. 1, the conduits 34 may also include radially outwardly extending support walls 78 that provide additional support for the conduits to limit shifting or bending of the conduits during the installation process, as also discussed further below.

To install the mesh 14 and form a pervious pavement, a subgrade surface 82 is prepared. The subgrade surface 82 may be any suitable material such as sand, gravel, and the like, and is generally leveled or graded as desired for a particular application, as generally understood in the art. Depending on the application, one or more forms 84 (FIG. 1) may be used to define the area to be paved. In FIG. 1, the forms 84 are arranged in a square over a relatively small area. It should be appreciated, however, that the mesh assembly 10 can be used in the paving of areas of substantially any size and shape, and that the size and number of conduits and the size of the mesh will vary for specific applications.

With the subgrade surface 82 prepared, the mesh 14 is positioned on the subgrade surface 82 within the forms 84 such that the second ends 46 of the conduits 34, which are open and do not include caps 62, engage the subgrade surface 82. Optionally, the second ends 46 may be pressed into the subgrade surface 82 or additional subgrade surface material can be back-filled around the second ends 46 such that the second ends 46 are located a distance below the subgrade surface 82. With the second ends 46 of the conduits 34 positioned on or in the subgrade surface 82, the conduits 34 support the mesh 14 a distance above the subgrade surface 82. In this regard, the conduits 34 function as a support or chair to space the mesh 14 above the subgrade surface 82.

Once the mesh assembly 10 is positioned on the subgrade surface 82, an optional subbase material 86 can be poured onto the subgrade surface 82 and over the mesh 14 such that the second ends 46 of the conduits 34 are covered by the subbase material 86. By way of example only, in the illustrated embodiment, the subgrade surface 82 is sand and the subbase material 86 may be pea gravel. Other materials or other combinations of paving layers may also be included depending on the particular application. For example, in some applications, rather than positioning the ends 46 of the conduits 34 on the subgrade surface 82, the ends 46 of the conduits 34 may be positioned on top of the subbase material 86, or the ends 46 may be positioned within the layer of subbase material 86.

After the mesh assembly 10 is positioned on the subgrade surface 82 and, optionally, after the subbase material 86 has been poured over the ends 46 of the conduits, pourable paving material 88 is poured onto the subgrade surface 82 or subbase material 86 and over the mesh 14. During pouring, the paving material 88 is poured into the spaces between the conduits 34 preferably in a controlled manner that avoids applying substantial paving material 88 directly onto the upper or first ends 38 of the conduits 34. In this regard, the caps 62 can function to limit or substantially prevent paving material 88 from entering into the passageways 54 of the conduits 34 such that the passageways 54 remain substantially open between their respective first and second ends 38, 46. Also, if one or more of the conduits 34 is provided with the support walls 78 (see FIG. 1), the support walls 78 function to limit shifting or bending of the conduits 34 and mesh 14 as the paving material 88 is poured. The paving material 88 is poured until a top surface 90 of the paving material is substantially even with the first ends 38 of the conduits 34. Various surface treatments, such as brooming or smoothing, may then be performed on the top surface 90 of the paving material 88 as desired.

After the desired surface treatment has been completed, the caps 62, which include ferromagnetic material either in the inserts 74 or in the caps 62 themselves, can be removed from the first ends 38 using a magnetic force. For example, as shown in FIG. 2, a magnet 94 can be engaged with or passed over the top of the caps 62 such that the resulting magnetic attraction pulls the caps 62 out of their respective first openings 42. The caps 62 can be removed individually using a single magnet 94, as illustrated, or larger, more powerful magnets can be passed over larger areas of pavement to remove multiple caps 62 substantially at the same time. Although it is generally contemplated that the caps 62 are removed before the pavement fully sets, sufficiently strong magnets and proper surface treatments can allow for the caps 62 to be removed after the pavement has fully set.

In one embodiment, after the caps 62 have been removed and the pavement has set, the upper portions 60 of the conduit 34 optionally can be filled with drainage material 98 (shown in phantom in FIG. 2) such as pea gravel or another pervious material. As shown in FIG. 2, the intersection 22 of the members 18*a*, 18*b* defines a support structure for supporting the drainage material 98 within the upper portion 60 of the conduit 34 and substantially preventing the drainage material 98 from falling into the lower portion 61 of the conduit 34.

Regardless of whether the upper portions 60 of the conduits 34 are filled with drainage material 98, when the paving material 88 has set and become substantially water impervious, the conduits 34 and, more specifically, the passageways 54 of the conduits 34 provide an open flow path for water to pass from the top surface 90 of the pavement through to the subgrade surface 82. The resulting pervious pavement can reduce the need for grading and more complex and substantial water runoff and collection structures such as sewers and drains by allowing water to pass directly through the pavement to the subgrade where it can percolate into the ground.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A mesh assembly for the formation of pervious pavement, the mesh assembly comprising:

a plurality of wires coupled together to form a mesh having a first side and a second side, the plurality of wires defining wire intersections; and, a plurality of conduits coupled to and formed separately from the mesh, each conduit including a first end defining a first opening on the first side of the mesh, and a second end defining a second opening on the second side of the mesh, each conduit surrounding one of the wire intersections such that the wire intersection is located within the conduit and is spaced a distance from each of the first end and the second end, wherein the second openings are adapted to be engageable with a subgrade surface, and wherein the plurality of conduits include sufficient rigidity to support and space the mesh above the subgrade surface.

2. The mesh assembly of claim 1, wherein each conduit extends substantially perpendicular to the mesh.

3. The mesh assembly of claim 1, further comprising a plurality of caps, each cap received by the first opening of a respective one of the plurality of conduits.

4. The mesh assembly of claim 3, wherein each cap includes a ferromagnetic insert for removing the cap from the first opening of the respective one of the plurality of conduits using a magnetic force.

5. The mesh assembly of claim 1, wherein at least some of the plurality of conduits define a longitudinal axis and include radially outwardly extending support walls.

6. The mesh assembly of claim 1, wherein the wire intersection located within each conduit divides the conduit into an upper portion and a lower portion and defines a support structure for supporting drainage material that is receivable within the upper portion.

7. The mesh assembly of claim 1, wherein each wire intersection is located a greater distance from the second end than from the first end of its respective conduit.

8. The mesh assembly of claim 1, wherein each conduit includes a sidewall defining openings, and wherein the plurality of wires extend through the openings in the sidewalls.

9. The mesh assembly of claim 8, wherein the plurality of wires are formed from a first material, and wherein the plurality of conduits are formed from a second material different from the first material.

10. Pervious pavement comprising:

a subgrade surface formed of subgrade material;

a mesh assembly supported by the subgrade material, the mesh assembly including a plurality of elongated structural members coupled together to form a mesh and defining intersections, the mesh assembly also including a plurality of conduits extending through and supporting the mesh a distance above the subgrade surface, each conduit having a first end defining a first opening on a first side of the mesh, and a second end defining a second opening on a second side of the mesh, the second end engaging the subgrade material, each conduit surrounding one of the intersections such that the intersection is located within the conduit and divides the conduit into an upper portion and a lower portion; and, substantially non-pervious paving material located in spaces between the plurality of conduits and extending between the subgrade surface and the first ends of the conduits, wherein the conduits provide an open flow path between a top surface of the non-pervious paving material and the subgrade material.

11. The pervious pavement of claim 10, wherein the second end of each conduit engages the subgrade surface.

12. The pervious pavement of claim 10, further comprising subbase material located in the spaces between the plurality of conduits and extending between the subgrade surface and the paving material.

13. The pervious pavement of claim 10, wherein each conduit extends substantially perpendicular to the mesh.

14. The pervious pavement of claim 10, wherein each intersection is located a greater distance from the second end than from the first end of its respective conduit.

15. The pervious pavement of claim 10, wherein each conduit includes a sidewall defining openings, and wherein the elongated structural members extend through the openings in the sidewalls.

16. The pervious pavement of claim 10, wherein the elongated structural members include wires formed from a first material, and wherein the plurality of conduits are formed from a second material different from the first material.

17. The pervious pavement of claim 10, further comprising previous drainage material located in the upper portion of each conduit and supported above the lower portion of each conduit by a respective one of the intersections.

18. A method of making pervious pavement, the method comprising:

preparing a subgrade surface formed of a subgrade material;

positioning a mesh assembly on the subgrade material, the mesh assembly including a plurality of elongated structural members coupled together to form a mesh and defining intersections, the mesh assembly also including a plurality of conduits extending through the mesh, each conduit having a first end defining a first opening on a first side of the mesh, and a second end defining a second opening on a second side of the mesh, each conduit surrounding one of the intersections such that the intersection is located within the conduit and divides the conduit into an upper portion and a lower portion, wherein positioning the mesh assembly on the subgrade material includes positioning the second end on the subgrade material such that the mesh is supported a distance above the subgrade surface; and, pouring a substantially non-pervious paving material into spaces between the plurality of conduits until a top surface of the paving material is substantially even with the first ends of the conduits, wherein the conduits provide an open flow path between a top surface of the non-pervious paving material and the subgrade material.

19. The method of claim 18, further comprising introducing a pervious drainage material into the upper portion of each conduit, wherein the drainage material is supported above the lower portion of each conduit by a respective one of the intersections.

20. The method of claim 18, wherein the conduits include sidewalls having openings formed therein, the method further comprising forming the mesh assembly by inserting the elongated structural members through the openings in the sidewalls.

21. The method of claim 18, wherein the conduits each include a cap received by the first opening, the method further comprising removing the caps from the first openings after pouring the substantially non-pervious paving material and before introducing the pervious drainage material.

22. The method of claim 18, wherein each cap includes a ferromagnetic member, and wherein removing the caps from the first openings includes passing a magnet over the caps.

* * * * *